United States Patent [19]

Williamson

[11] Patent Number: 4,873,731

[45] **Date of Patent: * Oct. 17, 1989**

[54] ADJUSTABLE BED SYSTEM

[76] Inventor: Robert M. Williamson, 1708 Matthews La., Austin, Tex. 78745

[ * ] Notice: The portion of the term of this patent subsequent to Jun. 20, 2006 has been disclaimed.

[21] Appl. No.: 305,009

[22] Filed: Feb. 1, 1989

Related U.S. Application Data

[63] Continuation-in-part of Ser. No. 54,203, May 26, 1987, Pat. No. 4,839,932.

[51] Int. Cl.[4] ..... A47C 20/08; A61G 7/06

[52] U.S. Cl. ..... 5/68; 5/72; 5/453; 5/446

[58] Field of Search ..... 5/447, 446, 453, 454, 5/455, 60, 66, 67, 68, 70, 71, 72, 431; 297/DIG. 3

[56] References Cited

U.S. PATENT DOCUMENTS

| | | | |
|---|---|---|---|
| 3,781,928 | 1/1974 | Swallert | 5/433 |
| 4,309,783 | 1/1982 | Cammack et al. | 5/68 |
| 4,527,298 | 7/1985 | Moulton | 5/453 |
| 4,678,014 | 7/1987 | Owen et al. | 5/453 |
| 4,707,027 | 11/1987 | Horvath et al. | 297/DIG. 3 |

*Primary Examiner*—Alexander Grosz

*Attorney, Agent, or Firm*—Thomas E. Sisson

[57] ABSTRACT

An adjustable bed system comprising inflatable bags under a hinged mattress support frame with necessary air blowers to raise or lower a head end and leg end of the mattress. The total unit being portable and adapted to fit any size bed.

2 Claims, 3 Drawing Sheets

ADJUSTABLE BED SYSTEM

This application is a continuation of co-pending U.S. patent application Ser. No. 054,203, filed May 26, 1987 which will be U.S. Pat. No. 4,839,932 on June 20, 1989.

BACKGROUND OF THE INVENTION

Even though there have been several patents issued for various devices or systems to raise or lower portions of a bed to improve comfort and change position of the occupant most have not been widely accepted. With increasing need for care for those bedridden for either short or long duration there is an increasing need for such occupants to perform as many functions as practicable for themselves. Further a proper adjustable system would allow increased comfort for those many people who read or watch TV while in bed. As yet we find no economical, easily used, and easily installed system for operation by the occupant for adjusting either or both the "head" portion and "leg" portion of a bed. We have considered the following patents in this general area:

| PATENT NUMBER | INVENTOR | DATE |
|---|---|---|
| 1,769,182 | E. J. NUNLIST | 11/6/1956 |
| 3,392,723 | C. E. CALVIN | 7/16/1968 |
| 3,392,412 | J. R. AYMAR | 7/16/1968 |
| 3,606,623 | J. R. AYMAR | 9/21/1971 |
| 3,667,075 | W. D. BALLARD, et al | 6/6/1972 |
| 3,978,530 | J. G. AMARANTOS | 9/7/1976 |
| 4,287,620 | H. C. ZUR | 9/8/1981 |
| 4,309,783 | M. A. CAMMACK | 1/12/1982 |

None of these fill the needs as outlined below for this invention. This present invention fills the need for:

1. a low cost system to adjust portions of a bed;
2. a system easily operable by fingertip control of the occupant;
3. a system variably adjustable within safe limits to raise either or both "head" portion of the bed and "leg" portion of bed;
4. a system that smoothly returns the bed to normal flat position;
5. a system intrinsically safe and easily sanitized;
6. a system with easily replaceable and readily available parts. The invention utilizes air bags below a hinged frame to raise the "head" portion of the bed and in the same manner utilizes a second set of air bags to raise the portion of the bed below the occupant's knees. The system has several unique features designed for ease of installation, ease and economy of manufacture, low cost transportation, ease of sanitation and economical parts replacements. The system is designed to be used with a normal bed and with variation in size may be used with a single bed, a double or standard bed, a queen size or a king size bed.

Briefly, the system comprises, 1. a metallic frame which may be of aluminum pipes which may be approx. 1" in diameter; the frame is hinged on either side of the bed and on either side of a flat section which may be about one foot in length with the flat section made to be fastened to the bed frame
2. a canvas cover for the total frame with approximately 1½" thick polyurethane section or similar spongy material inside the canvas and inside the frame so that when the frame is slipped between the mattress and box springs the mattress continues to be flat but approximately 1½" higher from the floor
3. a first pair of motor-blowers both to inflate and deflate the bags under the head portion of the bed and second pair of motor-blowers similarly to inflate or deflate the bags under the "foot" or "leg" portion of the bed
4. an electrical system with switches available to the occupant of the bed with necessary safeguards
5. pressure and vacuum cut offs to prevent overpressure of the bags or burn out of the motors by operation against a closed suction The motor-blowers used were standard vacuum cleaner motors (which have blower built in). Vacuum cleaner motor-blowers are commonly used with the air blowing back over the motor. The unique deflation-inflation set up in this invention may be briefly described in an overall way in the following paragraphs.

A vacuum cleaner motor-blower fits very neatly into a piece of 4½" PVC pipe and one motor-blower is slipped into the pipe with the motor facing in; a spring that fits loosely into the pipe is then slipped in and the second motor-blower is slipped in facing out so that we then have a spring separating the motor-blowers. We may activate one to blow air toward an inlet end of the assembly and, with this one deactivated the other one will pull air over the one that is deactivated so that by turning on one the air bags hooked to end of this assembly will be inflated; by shutting off the one used to inflate the bags and activating the other the bags will be deflated.

One end of the assembly is closed with a cap containing an outlet fitting that fits closely into the pipe to hold the motor-blower while the other end is closed with a similar end cap that slips completely within the straight section of plastic pipe to hold the other motor-blower firmly against the spring separating the two motor-blowers. This end or terminal cap contains an opening that may fit against a diaphragm in a third end cap that fits within the straight piece of pipe. This third cap contains an air chamber behind the diaphragm and an equalizing line between this air chamber and the chamber formed where the spring holds the two motor-blowers apart. When the diaphragm in the third end cap is lifted up from the second end cap there is communication with the chamber formed over the top of the bell shaped second end cap. This chamber contains several holes which may be of ¾" diameter leading to the outside air.

In operation when the inflation motor-blower is activated a vacuum is pulled on the spring containing chamber, the equalizing line from this chamber to the chamber in the third end cap pulls a slight vacuum in this third cap chamber thereby pulling the flexible diaphragm away from the second cap opening so there is then a path to pull outside air over the inactive "deflation" motor-blower, through the spring chamber and thence to inflate the air bags hooked to the first end cap via flexible tubing. When inflation to a desired point is completed and motor-blowers deactivated the diaphragm becomes an efficient check valve to hold air in bags.

In order to deflate the bags the "inflation" motor-blower is deactivated and the "deflation" motor-blower activated. Because of the equalizing line between the spring chamber and third end cap the pressure on either side of the diaphragm is the same but as soon as the "deflation" motor-blower is activated the blower outlet pressure will raise the diaphragm providing an air path to the exterior.

This briefly describes a unique system that meets the objectives outlined. Total weight of the system may be less than 75 pounds so that it is easily portable and shippable. The mass produced vacuum cleaner motor-blowers are quite inexpensive and fit into inexpensive housings. In fact the system used for deflation or inflation of the bags may be cheaper than an alternative system using only one motor-blower with a complex valving system. Various details have been left out of the above brief outline for clarity and brevity but would be easily supplied by one of normal skill in mechanical and electrical arts. A more complete explanation of a preferred embodiment will be found in the remaining specification and claims.

Many minor changes in details of this invention could be made but would still come within the spirit and purpose and fulfill the objectives outlined. For example, the support frame could be of molded plastic with hinges molded in the. frame; the motor-blower pair could be replaced with one motor-blower and with microprocessor controlled valving or could be replaced with one blower for inflation and one for deflation with proper valving.

STATEMENT OF THE INVENTION

The present invention comprises:

(a) a support assembly consisting of a cloth or canvas fitted over a hinged frame and containing foamed polyurethane in such manner as to maintain the mattress flat in the rest position but to have canvas easily removed for washing;

(b) in a first embodiment a canvas bellows comprised of multiple bags with each canvas bag replaceably containing a plastic or rubber inflatable pillow shaped bag and designed so as to be placed under the foregoing hinged frame to raise portions of the bed by inflating the bellows; in a second embodiment the plastic bags may be made in one or two units and used without the canvas bag containers;

(c) an easily replaced inflatable bag contained in each of the bellows in the first embodiment so that all bags may be temporarily removed for washing the canvas bellows or alternatively in the second embodiment only plastic bags are used and they may be sanitized with commercially available agents or cheaply replaced;

(d) two assemblies each containing two motor-blower units, air chambers, and a simple diaphragm valve to allow inflation of the plastic bags to raise the bed to any desired position and to remove the air to allow smooth return of the bed to the flat or "rest" position;

(e) a three position switch for each motor-blower assembly to allow finger tip control so one motor-blower fills the bellows to raise the "head" portion of the bed with the switch in one position whereas putting the switch in the other active position activates the other motor-blower to evacuate the bellows to return bed smoothly to flat position;

(f) a switch and motor-blower assembly raises and lowers the "leg" portion of the bed in the same way as outlined for the "head" portion;

(g) cut-off switches position-activated to cut off the motor when the head portion or leg portion reaches a desired maximum elevation; a normal mercury switch may be properly positioned in the hinged frame to accomplish this function;

(h) means to anchor the hinged support frame to the bed frame; in one embodiment two pipes on each side of the bed were connected to the support frame and were fitted into two larger pipes fastened to a steel plate with the plate then clamped to the bed frame;

(i) means to hold down the foot end of the hinged frame so that inflation of the bags raises the mattress in the knee area;

(j) a retainer bag fastened over the foot of the mattress and then tied to the bed frame to prevent the slippage of the mattress that would otherwise occur as the air bags are inflated.

A plastic support frame of sufficient rigidity could replace the hinged support frame we have described in detail.

As described the hinged frame with bags deflated and hoses disconnected that led from the motor-blower units will fold neatly into a package easily carried by one man. The motor-blower units, wiring and hoses may be neatly fitted into a second carrying case and are also easily carried. This portability and ease of installation is an important feature of the system. It is anticipated that a major use may be for those people who relax and read or watch TV in bed. Of course the invention also fulfills the need for temporary conversion of a normal bed to be similar to a hospital bed.

BRIEF DESCRIPTION OF THE DRAWINGS

FIG. 5 on the head end of the system.

DETAILED DESCRIPTION OF THE DRAWINGS

Figure 1:
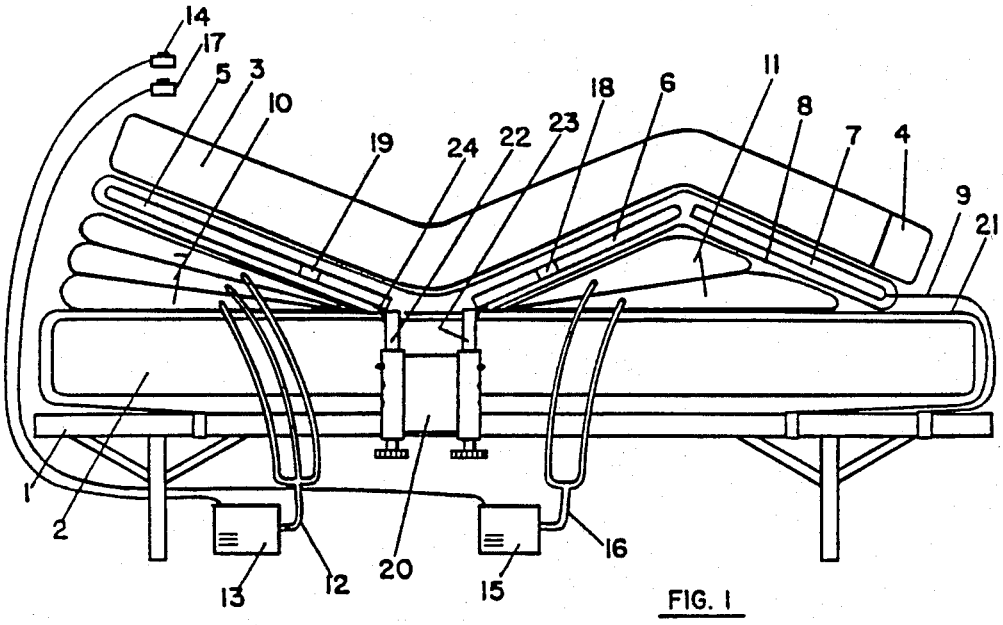
FIG. 1 shows a side view of the Adjustable Bed System in use with a mattress with both head portion and leg portion in a raised position.
Figure 2:
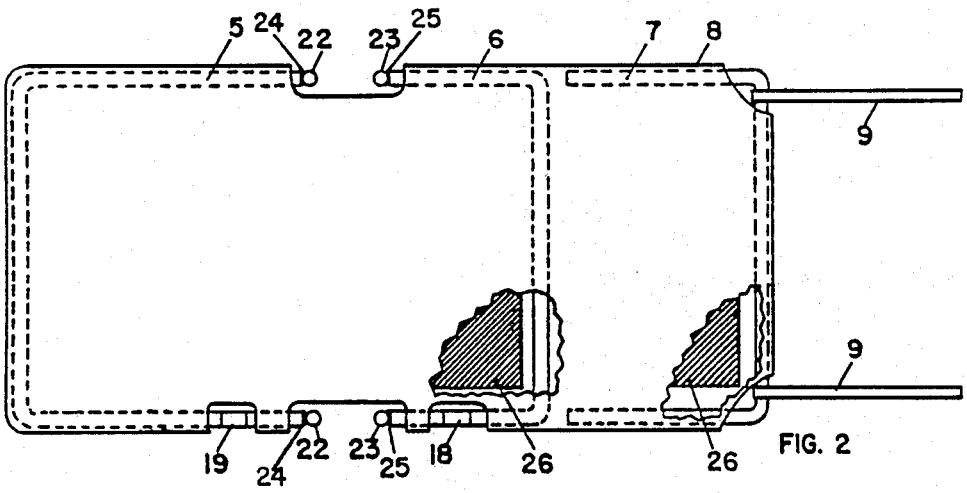
FIG. 2 shows top view details of a support frame used below the mattress and above the inflatable bags used to raise and lower either the head portion or leg portion of the mattress.

FIG. 1 shows a side view of the Adjustable Bed System with both the head end and leg end of the mattress in a raised position. In FIG. 1 we show a bedframe 1, box spring 2, mattress 3, a cloth mattress retainer 4 that may be sewed to the canvas bag covering 8; this canvas bag covering 8 holds in one unit a first section 5, a second hinged section 6 and a third section 7 of the assembly mattress support unit. The first section 5 may be approx. 1" diameter tubular aluminum pipe bent in a U shape and terminating in a hinged portion 22 on each end of the U shape, this hinge portion 22 with hinge 24 being outside the canvas bag covering 8. A second hinge section 6 is of similar shape but with each leg of the U being shorter than in the first section 5. In a similar fashion to the first section 5 this second section 6 is a U shape frame but facing the opposite direction from section 5 and terminating on each leg of the U with a hinged portion 23 designed to fit into the receiving pipes on clamp 20 in the same way as hinged portion 22. The second section 6 contains an electrical switch 18 which may be a mercury switch designed to break an electrical circuit when section 6 is in a maximum raised position. In the same way section 5 contains a similar electrical switch 19. A third section 7 is also U shaped with the legs of the U terminating in rounded ends with these legs pointing toward the center of a bed when the assembly is in use. Not shown here but indicated in FIG. 2, 26 are two sections of polyurethane foam approx. 1½" thick with one section filling the space between sections 5 and 6 and a second section filling the space in section 7. Other spongy type materials would serve the same purpose of allowing the mattress 3 to be flat when air bags 10 and 11 are deflated. Completing the hinged support assembly as already described are tie down straps 9 that tie each end of the U shaped frame 7 loosely to the bed frame or bed rails 1. These straps 9 allow the mattress 3 to move sufficiently to form the raised leg portions as shown by holding the very lower end close to the box springs to cause the air bags 11 to give desired mattress position as shown when inflated. Anchor straps 21 hold the air bags canvas covering 8 in place. A three position switch 17 operates motor-blower unit 15 and a similar three position switch 14 operates motor-blower unit 13. Inlet lines 12 go to head end air bags and inlet lines 16 go to leg end air bags 11.

In FIG. 2 we show view of the assembly support unit with the first section 5 terminating in hinged portion 22 connected by hinge 24; the second section 6 terminating in hinged portions 23 connected by hinges 25 and the third section 7 terminating in rounded ends and being loosely tied down to the bed frame with tie down straps 9. Cutaway sections of the canvas bag or envelope 8 that holds the assembly together show the 1½" thick polyurethane sections 26 that "fill" the canvas envelope 8 so that when air bags 10 and 11, FIG. 1 are deflated the mattress 3, FIG. 1 lies flat on the air bag unit 21, FIG. 5 or 39, FIG. 6 which lies on top of the box springs 2, FIG. 1. Position cut-off switches 19, FIG. 1 on head end 18, FIG. 1 on leg limit upward position of head end and leg end.

Figure 3:
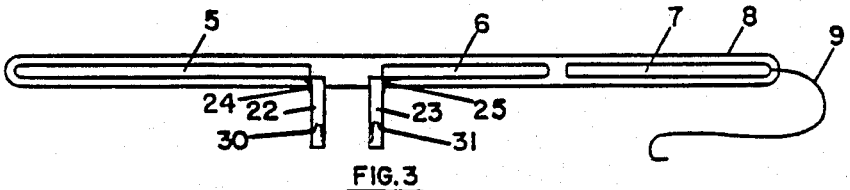
FIG. 3 shows side view details of the support frame.

FIG. 3 is a side view of the support assembly showing hinged section 22 and hinge 24 of section 5 which would be outside the canvas envelope 8 and contains a spring loaded pin 30, which pin allows height adjustment in clamp 20, FIG. 1. Similarly hinged section 23 with hinge 25 of section 6 contains a spring loaded pin 31 which also fits into Clamp 20, FIG. 1. Section 7 is contained in the canvas envelope 8 along with sections 5 and 6. Tie down straps 9 serve to hold down the lower end of section 7.

Figure 4:
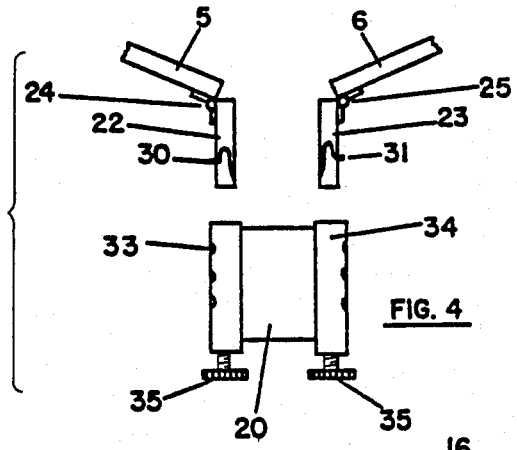
FIG. 4 shows details of a clamp used to anchor the support frame firmly to the bed rails.

FIG. 4 shows Clamp 20 and sections 22 and 23 of the support assembly hinged sections 5 and 6 with hinges 24 and 25. A spring loaded pin 30 is contained in hinged portion 22 with hinged portion 22 being conveniently made from aluminum pipe. The spring loaded pin 30 may be made as indicated but other ways of making a spring loaded pin would be equally suitable. Spring loaded pin 31 is similar to spring loaded pin 30 and is inside a tubular section 23. Tubular sections 33 and 34 are larger than hinged portion 22 tubular section 23, contain spaced openings to secure spring loaded pins 30 and 31, and are rigidly connected to flat plate body of Clamp 20. Screw clamps 35 may be used to clamp body 20 securely to the bed rails 1, FIG. 1. There is a similar set up on each side of the bed, and sections 5 and 6 of the support assembly may be rigidly clamped in place.

Figure 5:
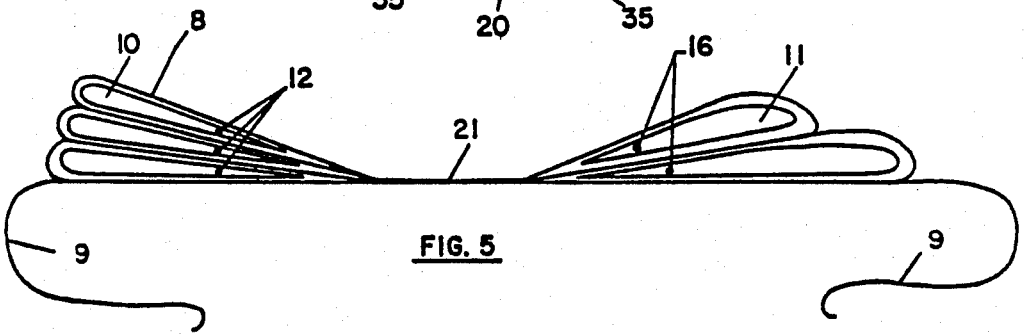
FIG. 5 shows one embodiment of an air bag assembly used below the Hinged Support Frame, FIG. 2.

FIG. 5 shows one preferred embodiment of the air bag unit 21 wherein plastic inflatable bags 10 on the head end and 11 on the leg end are contained in canvas envelopes 8. Connections 12 are shown for each of the head end air bags 10 and connection 16 for the leg end bags both of which may be ⅜" plastic nipples formed in the inflatable plastic bags 10 and 11. We have shown three bags in the head end and two bags in the leg end and all bags are shown equal size and this embodiment works well. However, the number and size of the air bags could vary and come within the spirit of this invention. The canvas bags of the air bag covering 8 may be conveniently made by folding and sewing one piece of canvas but methods of manufacture would be easily varied by one of ordinary skill in the trade. Tie down straps 9 are used to hold the air bags covering 8 in proper position on top of box springs 2, FIG. 1.

Figure 6:
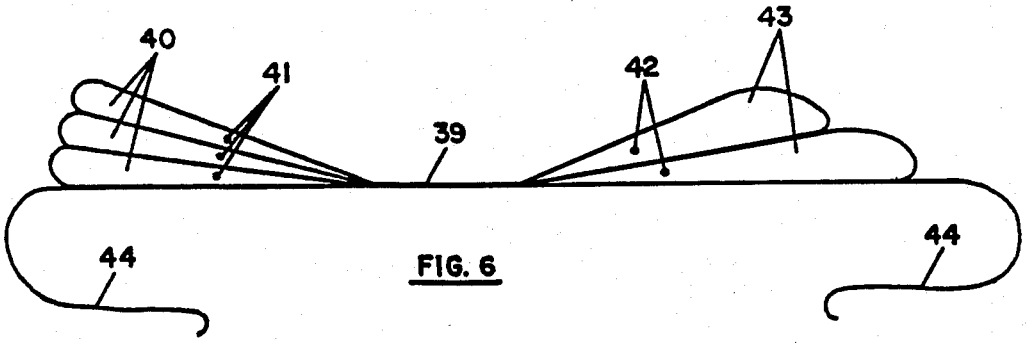
FIG. 6 shows a second embodiment of an air bag assembly that may be used below the hinged support frame, FIG. 2.

FIG. 6 shows a second embodiment of the air bags 40 to lift the head end and air bags 43 to lift the leg end of a mattress. Inlet-outlet nipples 41 and 42 for the air bags may be ⅜" diameter plastic fused into the plastic air bags. The bottom portion of the air bag unit 39 is connected to all air bags by fusion, sewing or gluing to a canvas section with tie down straps 44 to tie to bed rails 1, FIG. 1 to anchor unit 39 in place.

Figure 7:
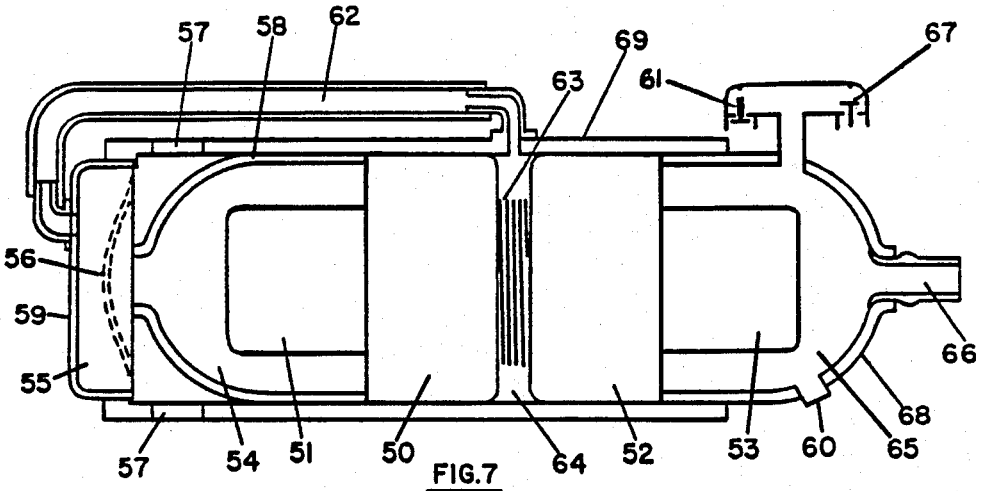
FIG. 7 shows details of a first motor-blower unit that may be used to inflate and deflate air bags shown in FIG. 4.

FIG. 7 shows one unit containing two common vacuum cleaner motor-blower units. There are two of these units, one, FIG. 7 being for inflation and deflation of the air bags at the head end and the other exactly similar unit FIG. 8 being to inflate or deflate the air bags at the foot end of the unit.

Looking at FIG. 7 the unit may be conveniently assembled by gluing end cap 58 and terminal cap 59 into a first end of pipe 69 which contains up to eight holes 57 that may be ¾" in diameter between end cap 58 and lower portion of terminal cap 59, the terminal end cap 59 containing a flexible diaphragm 56, an air chamber 55 and a connection for the equalizing line 62. The motor 51 and attached blower 50 is pushed into pipe section 69 to fit snugly against the end cap 58. A spring 63 that may be 3" in diameter and exert up to 15 pounds force when compressed to approx. 1" is placed between blower 50 and the second blower 52. This spring space forms chamber 64 which communicates with the end cap 59 through equalizing line 62 which may be ½ inch in diameter. End cap 68 may then fasten in a second end of pipe 69 so as to seat against blower 52 and to properly compress spring 63. End cap 68 may contain a positive pressure relief valve 61, a vacuum relief valve 67, a vacuum operated electrical cut off switch 60 and an outlet nipple 66.

Operation of this dual two way blower we have described will be as follows:

1. When blower 52 is activated by a two way electrical switch 14, FIG. 9, the blower will pull a vacuum in chamber 64, FIG. 7, and through the equalizing line 62 the pressure will be reduced in chamber 55 causing the flexible diaphragm 56 to lift off the seat on the end cap 58 and outside air may then flow through holes 57 over the inactive blower 51 and thence through chamber 64 and over motor 53 to outlet nipple 66 which is hooked to inflate plastic bags, FIG. 5 or FIG. 6. The pressures and sizes of equalizing line 62, diaphragm 56 and holes 57 are such in the unit as described that air continues to flow to inflate the bags until the user throws the switch 14 or until the position switch 18 or 19, FIG. 1 deactivates the motor 53. When the bags are inflated and motor 53 is deactivated back pressure through the equalizing line 62 pressures chamber 55 so that this pressure causes flexible diaphragm 56 to close firmly—the diaphragm acts as a very efficient check valve to hold the bags inflated.

Figure 9:
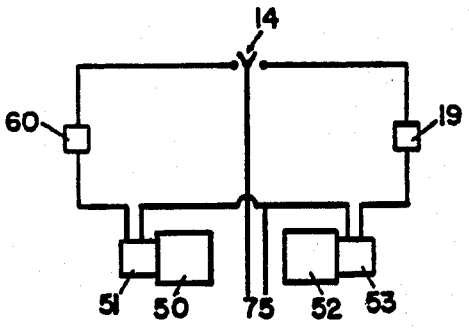
FIG. 9 shows detail of an electrical circuit for the first motor-blower unit.

When the occupant wishes to lower the head end of the bed by deflating the plastic bags on the head end he pushes the two way switch 14, FIG. 9, so that motor 51 is activated to start blower 50. The pressure in chamber 64 is equalized with the pressure in chamber 55 but the output pressure in chamber 54 from blower 50 coupled with a slight pressure reduction in chamber 64 and thereby in chamber 55 is sufficient to lift diaphragm 56 so that air from the plastic bags may flow to the outside through holes 57. When the air is completely removed from the bags the pressure will drop in chamber 65 and vacuum switch 60 will stop the motor 51 if the activation switch 14, FIG. 9, is in the closed position. This prevents motor 51 burn out by automatically shutting off motor 51 when bags are completely deflated.

Figure 8:
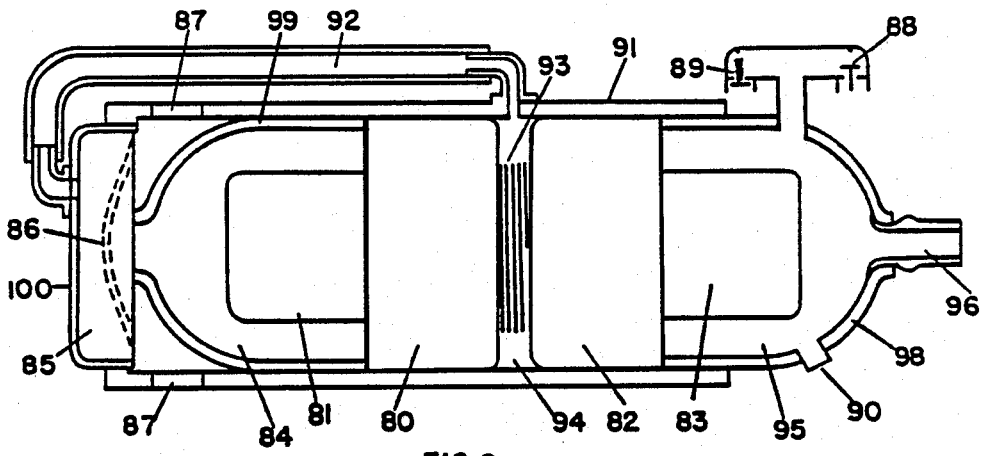
FIG. 8 shows a second motor-blower unit (exactly the same as this first motor-blower unit) used to deflate and inflate air bags shown in FIG. 4 and FIG. 5 under the head end and leg end of the mattress with cut offs of this unit by position switch in the "head" and "leg" end of the assembly frame.

FIG. 8 shows the second dual motor-blower unit which is used to inflate or deflate the bags at the leg end of the bed. Briefly, since we have described the similar unit in detail, we see blower 80 and motor 81 used for deflation contained in a bell shaped cap 99 with air chamber 84 communicating with outside air through holes 87 in containment structure or pipe 91 when flexible diaphragm 86 is in a raised position. Chamber 85 formed by cap 100 and flexible diaphragm 86 will be equalized in pressure with spring chamber 94 through equalizing line 92.

Blower 82 and motor 83 serve to inflate leg end bags and are held in place by spring 93 and end cap 98. End cap 98 contains chamber 95, nozzle 96, a vacuum cut off switch 90 and a vacuum relief valve 88 and pressure relief valve 89.

FIG. 9 shows the electrical circuits used with the dual motor blower units used for inflating and deflating the head end bags 10, FIG. 1 and described in detail under FIG. 7. In the circuits there is shown a 110V source 75 with one side of the circuit leading to a switch 14, this switch may be spring loaded to return to an open position with fingertip control to inflate or deflate with head end bags 10, FIG. 1. The switch may also be replaced or activated by a pneumatic controlled switch that will act the same as switch 14. Various other type switches may be used to perform functions of switch 14. When switch 14 is positioned to closed the circuit through position switch 19 (shown in place FIG. 1) through motor 53 and back to inlet 110V connection 75 the air bags 10, FIG. 1 will inflate. Note, using the desirable spring loaded-to-open switch 14 the bed will stay in position after inflation of the air bags because of diaphragm 56, FIG. 7 acting as a check valve as previously explained. When switch 14 is depressed to close the circuit through vacuum cut off switch 60, FIG. 7 and through motor 51 back to 110V 10, FIG. 1; the vacuum cut off switch 60 will open to stop motor 51 if the occupant continues to hold switch 14 in position after bags 10, FIG. 1 are completely deflated. This is desirable to prevent damage to motor 51.

Figure 10:
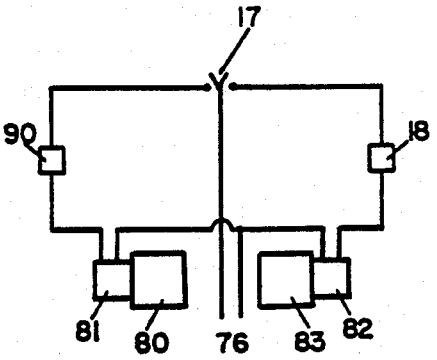
FIG. 10 shows a second electrical circuit for the second motor-blower unit.

FIG. 10 shows an exactly similar circuit to that of FIG. 9 but is included here for clarity. Briefly, the circuit shows inlet 110V source 76 with one leg of the 110V circuit leading to a central pole of two pole switch which is loaded to open. When switch 17 is positioned by the occupant to close the circuit through position switch 18, FIG. 1 the motor 82 will be activated and blower 83 will then act to inflate the leg end bags 11, FIG. 1. The position switch 18 will operate to deactivate motor 82 when the maximum desirable elevation of the lower portion of the bed is reached even if the occupant holds the switch 17 in a closed position too long.

When switch 17 is depressed so as to close the circuit through vacuum cut off switch 90 and through motor 81 the blower 80 is activated to deflate leg end bags 11, FIG. 1. Vacuum cut off switch 90 deactivates motor 81 if the occupant holds switch 17 in place too long. This protects motor 81.

I claim:

1. An inflatable bed system comprising:

a sectional mattress support frame;

a means for securing a mattress to said frame;

an inflatable member dispositionable beneath a section of said frame to raise and lower said frame;

a means for inflating and deflating said member, said inflating and deflating means further comprising:

first and second blowers oppositely positioned within a blower housing, said first blower adapted to positively pressurize said inflatable member to raise said frame and said second blower adapted to positively withdraw air from said inflatable member to lower said frame.

2. The invention of claim 1 wherein said inflating and deflating means further comprises:

a first inlet communicating outside air through a first chamber between said first and said second blower;

a flexible diaphragm disposed within a diaphragm chamber and adapted to alternatingly cover and uncover an opening in a second blower chamber, said diaphragm covering said opening in said second blower chamber when neither said first nor said second blower is activated;

a fluid conduit communicating said diaphragm chamber with said first chamber such that when said first blower is activated a decrease in pressure in said first chamber causes a first uncovering of said opening in said second blower chamber allowing air to be drawn through said first inlet, through said second blower chamber to said inflatable member to raise said frame and when said second blower is activated a second decrease in pressure in said first chamber causes a second uncovering of said opening in said second blower chamber allowing air to be drawn by said second motor from said inflatable member through said second blower chamber and out said first inlet to deflate said inflatable member to lower said frame.

* * * * *